US005287574A

United States Patent [19]

Kardell et al.

[11] Patent Number: 5,287,574

[45] Date of Patent: Feb. 22, 1994

[54] FITTED BED SHEET OR MATTRESS PAD WITH ELASTICIZED HEAD AND FOOT PANELS

[75] Inventors: Virgil L. Kardell; Janet L. Kardell, both of Wayne, Nebr.

[73] Assignee: Restful Knights, Wayne, Nebr.

[21] Appl. No.: 62,436

[22] Filed: May 12, 1993

[51] Int. Cl.[5] ..... A47G 9/02

[52] U.S. Cl. ..... 5/499; 5/497; 5/500

[58] Field of Search ..... 5/497, 499, 500

[56] References Cited

U.S. PATENT DOCUMENTS

| | | | |
|---|---|---|---|
| 2,454,463 | 11/1948 | Kromer | 5/334 |
| 2,598,141 | 5/1952 | Simpson | 5/334 |
| 2,624,893 | 1/1953 | Harris | 5/354 |
| 2,637,049 | 5/1953 | Kromer | 5/354 |
| 2,942,280 | 6/1960 | May, Jr. | 5/499 |
| 2,994,094 | 8/1961 | Hester | 5/334 |
| 3,020,566 | 2/1962 | Anderson et al. | 5/497 |
| 3,114,156 | 12/1963 | Cobb | 5/334 |
| 3,273,175 | 9/1966 | Anderson et al. | 5/334 |
| 3,438,068 | 4/1969 | Anderson et al. | 5/497 |
| 3,996,633 | 12/1976 | Burke | 5/334 |
| 4,338,693 | 7/1982 | Vitale | 5/500 |
| 4,651,370 | 3/1987 | Vitale | 5/497 |
| 4,672,702 | 6/1987 | Isham | 5/499 X |
| 4,682,379 | 7/1987 | Dugan | 5/500 |
| 4,692,546 | 10/1987 | Vitak | 5/500 X |
| 4,723,330 | 2/1988 | Kellogg et al. | 5/497 |
| 4,723,331 | 2/1988 | Weiss | 5/497 |
| 4,742,788 | 5/1988 | Dugan | 112/262.1 |
| 4,937,904 | 7/1990 | Ross | 5/497 |
| 4,962,546 | 10/1990 | Vitale | 5/497 |
| 4,985,953 | 1/1991 | Seago | 5/499 X |
| 5,029,353 | 7/1991 | Kimball et al. | 5/497 |
| 5,131,104 | 7/1992 | Larson | 5/504.1 |

*Primary Examiner*—Michael F. Trettel
*Attorney, Agent, or Firm*—Zarley, McKee, Thomte Voorhees & Sease

[57] ABSTRACT

A fitted bed sheet or mattress pad with elasticized head and foot panels comprising a first panel including a top portion and first and second side portions for covering the top and sides of the mattress. Elasticized head and foot panels are secured to the head and foot ends of the top portion with the head and foot panels defining a trapezoidal shape. The head and foot panels are comprised of a highly elasticized material with the design of the panels being such that it permits the bed clothing to accommodate various sizes of conventional innerspring mattresses or waterbed mattresses for any given size classification.

3 Claims, 2 Drawing Sheets

FITTED BED SHEET OR MATTRESS PAD WITH ELASTICIZED HEAD AND FOOT PANELS

BACKGROUND OF THE INVENTION

1. Field of the Invention

This invention relates to improved bed clothing such as bed sheets and mattress pads adapted to fit various sizes of conventional innerspring mattresses and waterbed mattresses for any given size classification.

2. Description of the Related Art

Many types of fitted bed sheets and mattress pads have been previously designed although the sheets and mattress pads are normally designed to fit a particular size mattress with the results being that a large number of the sheets and mattress pads must be manufactured and kept in inventory to accommodate the various sizes of mattresses. With the advent of the high profile mattress (extra depth mattress) and the waterbed mattress, a need has arisen for a product both in bed sheets and mattress pads which will accommodate the various sizes and shapes of mattresses.

SUMMARY OF THE INVENTION

A fitted bed sheet or mattress pad is disclosed which has elasticized head and foot panels so that the bed clothing will accommodate the mattress whether the mattress is seven inches deep or fourteen inches deep. The bed clothing comprises a first panel including a top portion and first and second side portions for covering the top and sides of the mattress. An elasticized head panel is secured to the head end of the top portion and an elasticized foot panel is secured to the foot edge of the top portion. The ends of the elasticized head and foot panels are cut at an angle to assure that the material will grab the bed for a secure fit no matter if the mattress is seven inches deep or fourteen inches deep. Not only do the head and foot panels allow a tight fit for various depth of mattresses but they also allow a variance in length and width of the mattress.

It is therefore a principal object of the invention to provide an improved fitted bed sheet with elasticized head and foot panels.

A further object of the invention is to provide an improved fitted mattress pad with elasticized head and foot panels.

A further object of the invention is to provide bed clothing capable of accommodating various sizes of a conventional innerspring mattress or a waterbed mattress for any given size classification.

Still another object of the invention is to provide improved bed clothing having elasticized head and foot panels inserted therein wherein the ends thereof are cut at angles to cause the bed clothing to securely grip the mattress and to accommodate mattresses of various sizes within a particular size classification.

These and other objects will be apparent to those skilled in the art.

DESCRIPTION OF THE PREFERRED EMBODIMENT

Figure 1:
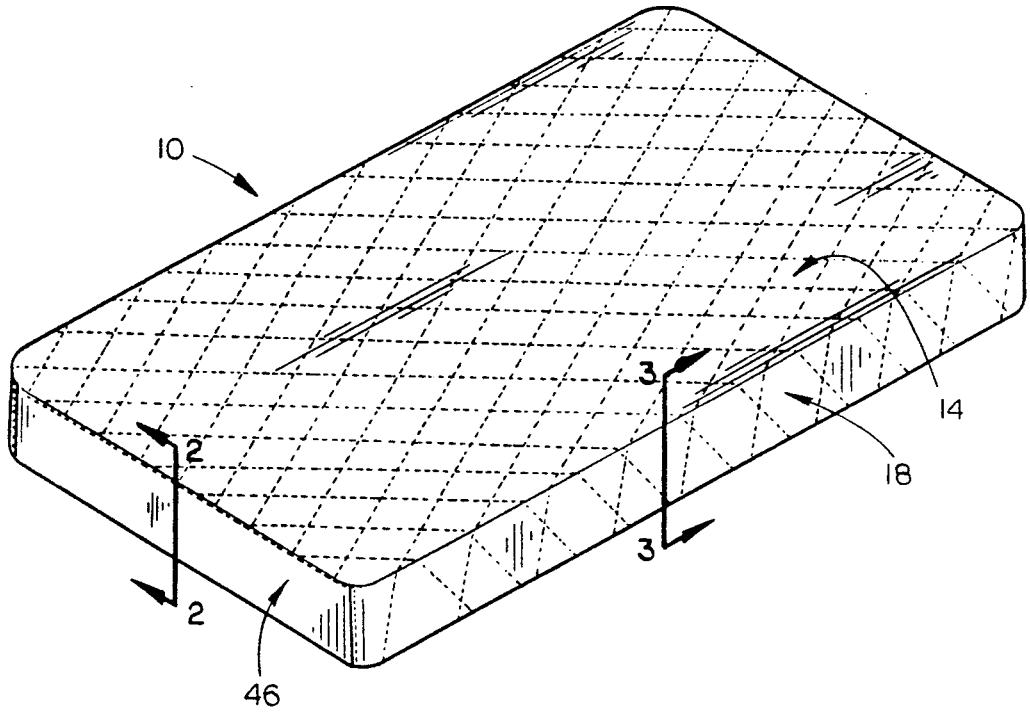
FIG. 1 is a perspective view of a mattress pad built according to this invention with the mattress pad being positioned on a mattress.
Figure 2:
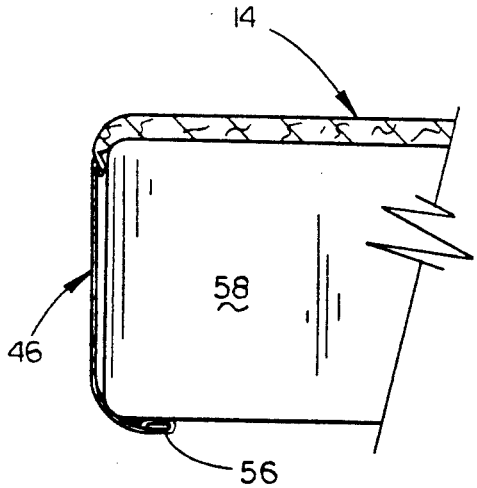
FIG. 2 is an enlarged sectional view seen on lines 2—2 of FIG. 1.
Figure 3:
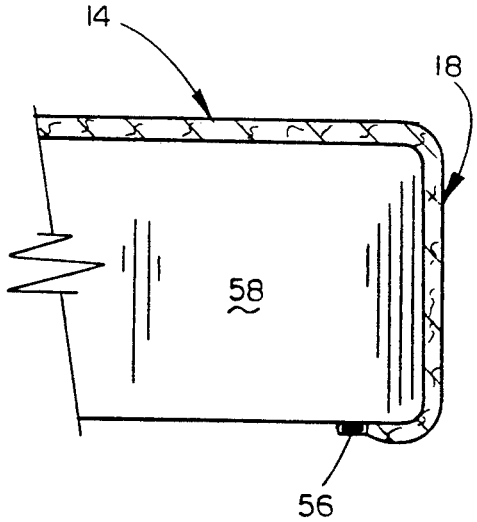
FIG. 3 is an enlarged sectional view seen on lines 3—3 of FIG. 1.
Figure 4:
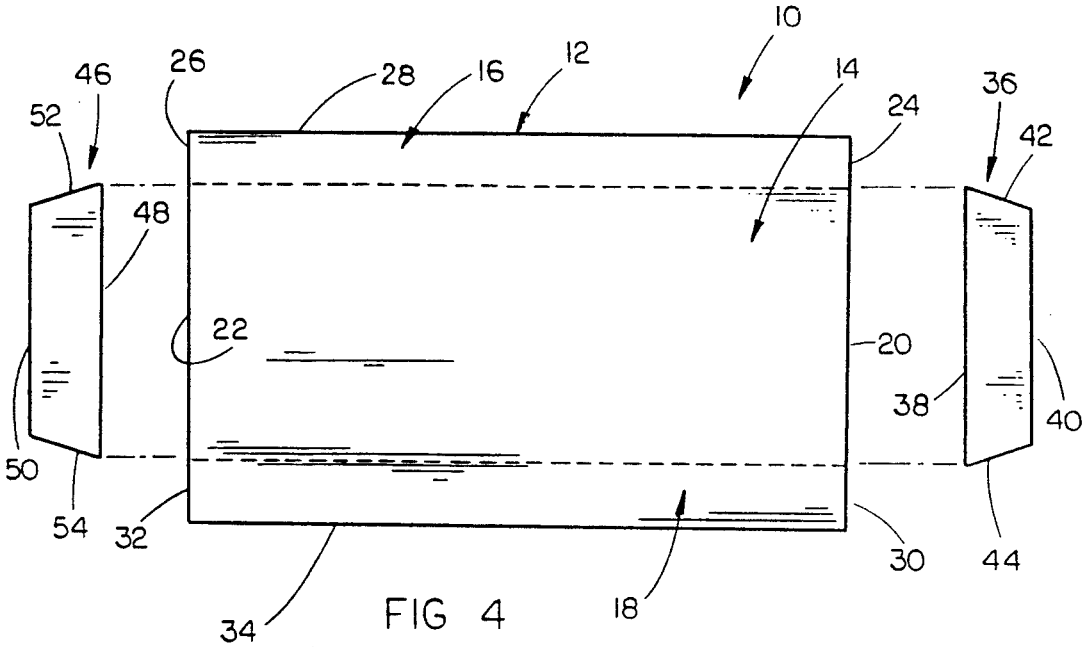
FIG. 4 is a top plan view of the bed clothing prior to the head and foot panels being secured thereto.
Figure 5:
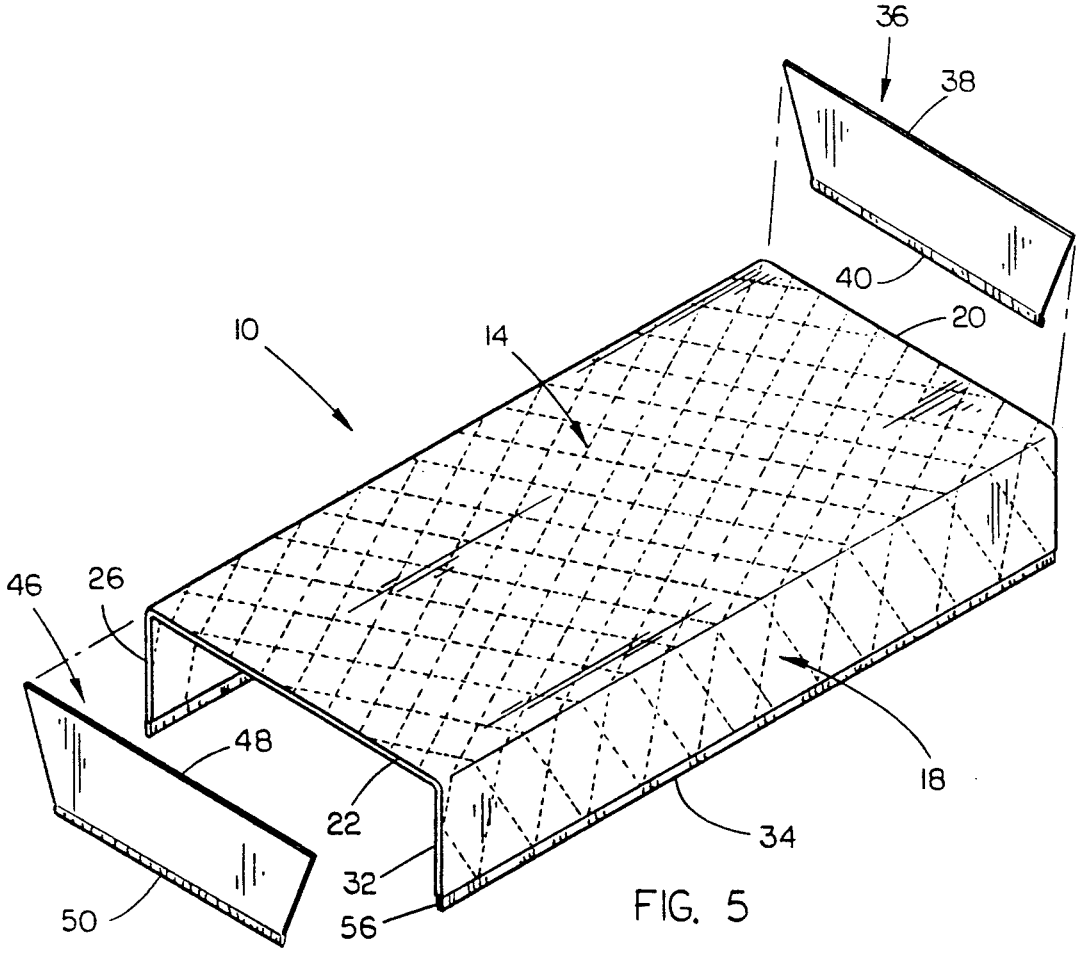
FIG. 5 is a perspective view of the bed clothing prior to the head and foot panels being secured thereto.

The numeral 10 refers to the improved bed clothing of this invention which may either be a mattress pad or a fitted bed sheet. The design of the bed clothing permits you to accommodate various sizes of conventional innerspring mattresses and waterbed mattresses for any given size classification as will be described in more detail hereinafter.

For purposes of description, the bed clothing of this invention will be described as comprising a mattress pad which normally would be padded and quilted and would be constructed of conventional material. Pad 10 includes a first panel 12 having a top portion 14, a first side portion 16, and a second side portion 18.

Top portion 14 includes a head edge 20 and a foot edge 22. First side portion 16 includes a head edge 24, foot edge 26 and lower edge 28. Second side portion 18 includes a head edge 30, foot edge 32 and lower edge 34.

The numeral 36 refers to a head panel of highly elasticized material such as LYCRA TM and including a top edge 38, bottom edge 40 and side edges 42 and 44. As seen in the drawings, head panel 36 defines a trapezoidal shape wherein the bottom edge 40 has a length which is shorter than the top edge 38 and wherein the side edges 42 and 44 have equal lengths.

The number 46 refers to a foot panel comprised of a highly elasticized material such as LYCRA TM and including a top edge 48, bottom edge 50 and side edges 52 and 54. As seen in the drawings, foot panel 46 defines a trapezoidal shape wherein the bottom edge 50 has a length shorter than the top edge 48 and wherein the side edges 52 and 54 have equal lengths.

An elasticized cord 56 is secured and extends around lower edge 28 of side portion 16, bottom edge 40 of head panel 36, lower edge 34 of side portion 18, and bottom edge 50 of foot panel 46.

The head and foot panels 36 and 46 are secured to the panel 12 as illustrated in the drawings by conventional sewing methods. It is extremely important to note that the bottom edges of the head and foot panels have a length shorter than the top edges thereof so that the head and foot panels will exert greater tension on the side portions of panel 12 near the lower edges thereof to assure that the bed clothing will grab the mattress for a secure type fit no matter if the mattress is seven inches deep or fourteen inches deep. Not only do the head and foot panels allow a tight fit for various depths of mattresses, they also allow a variance in length and width of the mattress. An example of multiple fits with one size would be an Eastern king conventional mattress (78 inches×80 inches), California king conventional mattress (72 inches×84 inches), and a king waterbed mattress (72 inches×84 inches) with all three sizes being handled by one size of bed clothing due to the unique capabilities of the bed clothing to accommodate various sizes. An additional example of multiple fits with one size would be a queen conventional mattress (60 inches×80 inches), and a queen waterbed mattress (60 inches×84 inches) with both sizes again being handled with one size. Additional sizes would be specifically designed for the following sizes: super-single waterbed (48 inches×84 inches), full size conventional (54 inches×75 inches) and twin size conventional (39 inches×75 inches). By utilizing the bed clothing of this invention, the last three sizes listed will allow a tight fit on multiple depth mattresses varying in depth from seven inches to fourteen inches.

It can therefore be seen that a novel fitted bed sheet and mattress pad has been provided which has elasticized head and foot panels positioned therein to enable the bed clothing to accommodate various sizes of a conventional innerspring mattress or a waterbed mattress for any given size classification. It can therefore be seen that the invention accomplishes at least all of its stated objectives.

I claim:

1. An improved bed clothing capable of accommodating various sizes of a conventional innerspring mattress and a waterbed mattress for any given size classification comprising:

a first panel of a quilted material including a top portion and first and second side portions for covering the top and sides of the mattress, said top portion having head and foot edges extending between said first and second side edges, said first and second side portions each having head, foot, and bottom edges, a highly stretchable head panel secured to said head edge of said top portion and to said head edge of said first and second side portions, a highly stretchable foot panel secured to said foot edge of said top portion and to said foot edges of said first and second side portions, said head panel including a top edge, a bottom edge, and first and second side edges, said bottom edge of said head panel having a shorter length than said top edge of said head panel, said first and second side edges of said head panel extending downwardly and inwardly from said top edge of said head panel to said bottom edge of said head panel, said foot panel including a top edge, a bottom edge and first and second side edges, said bottom edge of said foot panel having a shorter length than said top edge of said foot panel, said first and second side edges of said foot panel extending downwardly and inwardly from said top edge of said foot panel to said bottom edge of said foot panel, said top edge of said head panel being secured to said head edge of said top portion, said first side edge of said head panel being secured to said head edge of said first side portion, said second side edge of said head panel being secured to said head edge of said second side portion, said top edge of said foot panel being secured to said foot edge of said top portion, said first side edge of said foot panel being secured to said foot edge of said first side portion, said second side edge of said foot panel being secured to said foot edge of said second side portion.

2. The improved bed clothing of claim 1 wherein an elasticized cord is secured to said bottom edge of said head panel, said bottom edge of said first side portion, said bottom edge of said foot panel, and said bottom edge of said second side portion.

3. The improved bed clothing of claim 1 wherein said head and foot panels each define a trapezoidal shape wherein the side edges thereof are of equal length.

* * * * *